US005480469A

United States Patent [19]

Storstrom et al.

[11] Patent Number: 5,480,469

[45] Date of Patent: Jan. 2, 1996

[54] POWDER MIXTURE AND METHOD FOR THE PRODUCTION THEREOF

[75] Inventors: Helge Storstrom, Hoganas; Bengt Floren, Bjuv, both of Sweden

[73] Assignee: Hoganas AB, Hoganas, Sweden

[21] Appl. No.: 400,678

[22] Filed: Mar. 8, 1995

Related U.S. Application Data

[63] Continuation of Ser. No. 137,103, filed as PCT/SE92/00187, Mar. 24, 1992, abandoned.

[30] Foreign Application Priority Data

Apr. 18, 1991 [SE] Sweden ..... 91011544

[51] Int. Cl.[6] ..... B22F 1/02

[52] U.S. Cl. ..... 75/228; 75/255; 419/36

[58] Field of Search ..... 419/36, 37, 65, 419/66; 75/228, 255; 264/63

[56] References Cited

U.S. PATENT DOCUMENTS

| | | | |
|---|---|---|---|
| 4,401,482 | 8/1983 | Green et al. | 148/104 |
| 4,483,905 | 11/1984 | Engstrom | 428/570 |
| 4,902,471 | 2/1990 | Penkunas et al. | 419/33 |
| 5,071,821 | 12/1991 | Smith et al. | 503/208 |
| 5,076,339 | 12/1991 | Smith | 164/72 |
| 5,154,881 | 10/1992 | Rutz et al. | 419/37 |

FOREIGN PATENT DOCUMENTS

| | | |
|---|---|---|
| 0264287 | 4/1988 | European Pat. Off. . |
| 0329475 | 8/1989 | European Pat. Off. . |
| 3132277 | 6/1982 | Germany . |

*Primary Examiner*—Donald P. Walsh
*Assistant Examiner*—J. N. Greaves
*Attorney, Agent, or Firm*—Kane, Dalsimer, Sullivan, Kurucz, Levy, Eisele and Richard

[57] ABSTRACT

A powder metallurgical mixture and a method for the production thereof are described. In addition to powders of base metal and additives, such as graphite, Cu, Ni, Mo, MnS, $Fe_3P$ etc and, optionally, a lubricant, the mixture comprises a binder which is at least one diamide wax of the general Formula I:

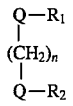

(I)

wherein $R_1$ and $R_2$ are the same or different and represent a straight, saturated, optionally OH-substituted alkyl group having 13–24 carbon atoms, Q is

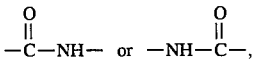

and n is 1–10, the binder being present in molten and subsequently solidified form for binding together the powder particles of the additives with the base metal particles. When producing the mixture, the binder is added to the mixture, and a homogeneous mixture is provided by mixing, the homogeneous mixture is heated to about 90°–160° C. during mixing and melting of the binder, and subsequently the mixture is cooled during mixing, until the binder has solidified.

5 Claims, No Drawings

POWDER MIXTURE AND METHOD FOR THE PRODUCTION THEREOF

This is a continuation of application Ser. No. 08/137,103, filed as PCT/SE92/00187, Mar. 24, 1992, now abandoned.

The present invention relates to a powder mixture and a method for the production thereof. More particularly, the invention relates to an iron-based powder mixture for use in powder metallurgy.

Powder metallurgy is a well-established technique which is used for the production of various components for e.g. the motor industry. In the production of components, a powder mixture is compacted and sintered so as to provide a part of any desired shape. The powder mixture comprises a base metal powder as the main component and admixed, pulverulent additives. The additives can be, for example, graphite, Ni, Cu, Mo, MnS, $Fe_3P$ etc. For reproducible production of the desired products by using powder metallurgical techniques, the powder composition used as starting material must be as homogeneous as possible. This is usually achieved in that the components of the composition are homogeneously intermixed. Since the pulverulent components of the composition differ in size, density and shape, there will however be problems with the homogeneity of the composition.

Thus segregation occurs during the transport and handling of the powder composition because powder components of higher density and smaller size than the base metal powder tend to collect towards the lower part of the composition, whereas powder components of lower density tend to rise to the upper part of the composition. This segregation implies that the composition will be nonuniformly composed, which in turn means that parts made of the powder composition are differently composed and consequently have different properties. A further problem is that fine particles, particularly those of lower density, such as graphite, cause dusting in the handling of the powder mixture.

In general, the additives are powders having a smaller particle size than the base metal powder. While the base metal powder thus has a particle size smaller than about 150 μm, the additives mostly have a particle size smaller than about 20 μm. This smaller particle size results in an increased surface area of the composition, which in turn implies that its flowing properties, i.e. its capacity of flowing as a free-flowing powder, are impaired. The impaired flow manifests itself in increased time for filling dies with powder, which means lower productivity and an increased risk of variations in density in the compacted component, which may lead to unacceptable deformations after sintering.

Attempts have previously been made at solving the problems described above by adding different binders and lubricants to the powder composition. The purpose of the binder is to bind firmly and effectively the particles of additives, such as alloying components, to the surface of the base metal particles and, consequently, reduce the problems of segregation and dusting. The purpose of the lubricant is to reduce the friction of the powder composition and thus increase the flow thereof and also reduce the ejection force, i.e. the force required to eject the finally compacted product from the die.

In the prior art technique in this field there are examples of a large number of different binders of natural or synthetic origin, such as oils, thermoplastic resins and curable resins. Among known lubricants, mention can be made of waxes and metal soaps. Metal soaps which in practice almost exclusively are zinc stearates, have come to constitute an ever increasing problem.

In fact, when sintering the metal powder, zinc sublimes in the sintering furnace and contaminates it. This requires cleaning of the furnace, which reduces productivity. This has implied that among the manufacturers using powder metallurgical methods, requirements for powder metallurgical compositions which do not contain metal soaps, such as zinc stearate, have been expressed.

Below, some examples of the prior art technique will be provided.

U.S. Pat. No. 4,483,905 discloses an iron-based powder composition containing a binder which is selected among polyethylene glycol, polypropylene glycol, polyvinyl alcohol or glycerol. A lubricant, such as zinc stearate, can also be added.

U.S. Pat. No. 4,676,831 discloses an iron-based powder composition which contains tall oil as a binder and which also can include a lubricant, such as zinc stearate.

EP application 0,264,287 discloses a powder composition containing a binder which is insoluble in water and selected among homopolymers or copolymers of vinyl acetate; cellulosic ester or ether resins; methacrylate polymers and copolymers; alkyd resins; polyurethane resins; and polyester resins. The binder is normally used together with a lubricant, e.g. zinc stearate or synthetic wax. There is no indication that any of the lubricants stated could be used as a binder.

Powder Metallurgy, Vol. 12, 1969, No. 24, Grenoble, France, pp 298–304, by R. Meyer, J. Pillot and H. Pastor, describes tests with various lubricants, inter alia N, N"-ethylene-bis-stearamide ("Acrawax"). There is no indication that any of the lubricants examined could be used as a binder.

EP application 0,310,115 corresponding to U.S. Pat. No. 4,946,499 discloses an iron-based powder mixture with a binder which is a combination of an oil and a metal soap or a wax which are molten together. When producing the composition, the powder is mixed with the metal soap or the wax, and oil, and the mixture is heated so that the oil and the metal soap or wax melt together, whereupon the mixture is cooled. Vegetable oils, mineral oils and fatty acids are mentioned as useful oils. As useful metal soaps or wax, merely zinc stearate is exemplified. Only the combination oleic acid/zinc stearate has a sufficient flow.

The published JP application Publication No. 58-193302 discloses the use of a pulverulent lubricant, such as zinc stearate, as a binder. The pulverulent lubricant is added to the powder composition and heated to melting during continued mixing, whereupon the mixture is cooled. Only zinc stearate is shown as an example of lubricants.

The published JP application Publication No. 1-219101 also discloses the use of a lubricant as a binder. When producing a powder composition, metal powder is mixed with a lubricant and heated above the melting point of the lubricant, whereupon cooling is effected. The lubricants which are generally used in the powder metallurgy, such as zinc stearate, lithium stearate, lead stearate, calcium stearate, magnesium stearate, are stated to be suitable binders. Thus only metal soaps are involved, and the only example given is zinc stearate.

The published JP application Publication No. 206401/1988 discloses binding of powder metallurgical powders by using a combination of a pulverulent binder and a lubricant. The binder can be curable resin powder, e.g. phenolic resin, epoxy resin, or thermoplastic resin powder, e.g. nylon, polyethylene, polypropylene and other waxes. Only the use of phenolic resin is exemplified. The lubricant can be metal soaps, higher fatty acids or common lubricants in the powder metallurgy. Only the use of zinc stearate is exemplified. When producing the powder composition, the metal powder is first mixed with a binder powder and subsequently with a lubricant powder. Then the composition is heated to melt the binder and the lubricant, whereupon it is cooled.

The published JP application Publication No. 47201/1990 discloses binding of a powder composition by using a combination of binder and zinc stearate and/or wax which are molten together. In the binding, zinc stearate and/or wax are added to the powder composition and mixed by means of an agitator which is operated at a peripheral speed of 2–10 m/s. Then a binder is added which is selected among cellulose derivatives, curable resins, thermoplastic resins, polyvinyl alcohol, vegetable oils, mineral oils or oils, such as fatty acids, and the agitation is continued and the mixture heated to 90°–150° C. Then the composition is cooled to 85° C. or less, while agitating at a speed of 2–5 m/s. In the examples stated, only zinc stearate in combination with oleic acid, rice oil or polyvinyl alcohol are used.

The published JP application Publication No. 57602/1990 concerns a further development of the binding process disclosed in the above-mentioned EP application 0,310,115. Instead of oleic acid, use is made of a saturated fatty acid having a melting point above 30° C. Examples are given of stearic acid and n-capric acid in combination with zinc stearate.

The object of the present invention is to try to reduce or eliminate the problems which have been described above in connection with the prior art technique. In particular, the object of the invention is to provide a powder metallurgical mixture with a binder which does not contain any metal soap, but all the same results in satisfactory binding accompanied by reduced segregation and dusting. A further object is that the mixture should have a satisfactory flow.

These and other objects are achieved by using a special diamide wax as a binder.

More particularly, the invention provides a powder mixture containing a base metal powder, pulverulent additives, a binder and, optionally, a pulverulent lubricant, characterised in that the binder is at least one diamide wax of the general Formula I:

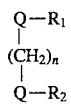

(I)

wherein $R_1$ and $R_2$ are the same or different and represent a straight, saturated, optionally OH-substituted alkyl group with 13–24 carbon atoms, Q is

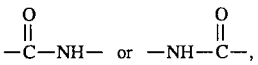

and n is 1–10, and that the binder is present in a molten and subsequently solidified form for binding together the powder particles of the additives with the powder particles of the base metal.

Furthermore the invention provides a method of producing a powder mixture containing a base metal powder, pulverulent additives, a binder and, optionally, a pulverulent lubricant, characterised by adding the binder to the base metal powder and the additive powder, said binder being at least one diamide wax of the general Formula I:

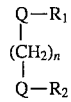

(I)

wherein $R_1$ and $R_2$ are the same or different and represent a straight, saturated, optionally OH-substituted alkyl group having 13–24 carbon atoms, Q is

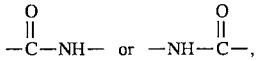

n is 1–10, by preparing a homogeneous mixture, heating the mixture to about 90°–160° C. during mixing and melting of the binder, and subsequently cooling the mixture during mixing, until the binder has solidified.

Further features and advantages of the invention are defined below and in the accompanying claims.

It has been found that the binder used according to the invention satisfies most of the above-mentioned criteria of a binder for powder metallurgical mixtures, and in particular it is free from metal soaps, such as zinc stearate. To make the binder according to the invention efficiently exert its binding effect, it is present in molten and, subsequently, solidified form, i.e. the homogeneous powder mixture is contacted with the binder in the molten state thereof, whereupon the binder is allowed to solidify. This so-called melt-bonding technique is per se known from e.g. some of the above-mentioned references. As far as is known, this technique has however never been applied in connection with waxes, and particularly not in connection with the specific diamide waxes according to the present invention. Although some of the above references mention waxes, these are only part of a general enumeration of different lubricants, of which metal soaps, especially zinc stearate, are emphasised. Thus it is obvious that waxes-have previously been used as lubricants only, and not as binders, and above all waxes have not been utilised as a main binder while applying the so-called melt-bonding technique.

The fact that this has not occurred earlier, although waxes are per se known and the melt-bonding technique is also per se known, must be considered surprising in view of the great advantages obtained, especially since the problems with metal soaps are solved.

As mentioned above, the binder according to the invention consists of diamide waxes of the general Formula I. In Formula I, $R_1$ and $R_2$ can be the same or different and preferably are identical. $R_1$ and $R_2$ are straight, saturated alkyl groups having 13–24, preferably 15–21 carbon atoms. Moreover, $R_1$ and $R_2$ should be saturated, since unsaturation provides binders that impart insufficient flow to the powder composition. $R_1$ and $R_2$ can be OH-substituted. The two groups $R_1$ and $R_2$ are interlinked by a straight, saturated carbon chain having 1–10, preferably 2–6 carbon atoms. Between this carbon chain and the groups $R_1$ and $R_2$ there are two amide groups in which the nitrogen atom is bound either to $R_1$ and $R_2$ respectively or, preferably, to the carbon chain.

Examples of diamide wax binders comprised in Formula I according to the invention are: ethylene-bis-palmitinamide, ethylene-bis-stearamide, ethylene-bis-arachinamide, ethylene-bis-behenamide, hexylene-bis-palmitinamide, hexylene-bis-stearamide, hexylene-bis-arachinamide, hexylene-bis-behenamide, ethylene-bis-12-hydroxystearamide, distearyladipamide etc.

The presently most preferred compound of Formula I is ethylene-bis-stearamide having the formula

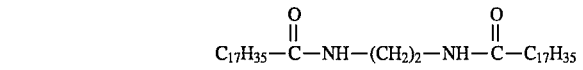

The binder according to the present invention of Formula I can be used as a sole binder in the powder mixture, or in combination with one or more other binders.

When carrying out the method according to the invention it is important that the components of the mixture, including the binder, are homogeneously intermixed. This is achieved by mixing in a mixing device the base metal powder and the pulverulent additives, such as graphite, Cu etc, until a homogeneous powder mixture is obtained. Subsequently the binder is added in powder form and mixed into the mixture, until the binder has been homogeneously distributed. Alternatively, the pulverulent binder can be added from the very beginning together with the remaining pulverulent additives, whereupon the mixing operation is performed until the mixture is homogeneous. During continued mixing, the mixture is then heated until the binder melts, which occurs at about 90°–160° C., preferably at about 120°–150° C. The melting point of the binder according to the invention should be at least about 90° C., since ambient and die temperatures in the order of about 80°–90° C. may occur. On the other hand, the binder should not have too high a melting point, thereby minimising the amount of energy required to heat the powder mixture so that the binder melts. Therefore, an upper limit of the melting point of the binder has been set at a temperature of about 160° C.

When the molten binder has been uniformly distributed in the mixture during the mixing operation, the mixture is cooled to make the binder solidify and, thus, exert its binding effect between the base metal particles and the smaller particles of additives, such as graphite, Cu, Ni, Mo, MnS, $Fe_3P$ etc, which are arranged on the surface thereof. It is important that also the cooling operation is performed during mixing, thereby maintaining the homogeneity of the mixture. The mixing during cooling need not, however, be as powerful as the preceding mixing for the provision of a homogeneous mixture. When the binder has solidified, the powder mixture is ready to use.

The amount of binder added to the composition is about 0.05–2% by weight, preferably about 0.2–1% by weight, based on the weight of the mixture, i.e. including the binder. Below about 0.05% by weight of binder results in unsatisfactory binding, whereas above about 2% by weight of binder results in undesired porosity of the final product. Within the limits set, the amount of binder is selected according to the amount of additives, a larger amount of additives requiring a larger amount of binder and vice versa.

Optionally, a conventionel lubricant can be added to the powder mixture after the binder has solidified, thereby improving the flow and bulk density of the mixture. However, this is not mandatory.

To facilitate the understanding of the invention, it will be illustrated below by means of a non-restrictive example.

In the tests described in the example, the following materials and methods have been used.

As base metal powder, atomised iron powder was used, having an average particle diameter of about 63 μm, all particles being smaller than 150 μm.

As additives, powders of nickel (Ni) and graphite were used, the Ni-powder having an average particle size of about 8 μm and the graphite powder an average particle size of about 4 μm.

As binder, use was made of the diamide waxes mentioned in the example which had been triturated into a particle size of less than 560 μm (28 mesh).

The mixing of the powder mixtures was effected in two steps, the components of the mixture first being premixed with each another in a mixing device, type Lödige, supplied by Gebr. Lödige Maschinenbau GmbH, W-4790 Paderborn, Germany, for 2 min, whereupon the resulting mixture was transferred to a cylindrical mixing device having a height of about 300 mm and a diameter of about 80 mm and provided with a double helix mixer and a heating jacket with adjustable heating. In the cylindrical mixing device the powder was agitated and heated to about 150° C. for about 15 min to melt the binder. The temperature was then kept at about 150° C. during continued agitation for about 3 min, whereupon the heat was shut off and the mixture was allowed to cool to about 100° C. during agitation to make the binder solidify. The cooling operation took about 15–30 min. Subsequently, the finished powder mixture was removed from the mixing device at about 100° C., and its properties were tested after about 24 hours.

The flow of the powder mixtures was measured according to Swedish Standard SS 111031 which corresponds to International Standard ISO 4490–1978.

The apparent density (AD) of the powder mixtures was measured according to Swedish Standard SS 111030 which corresponds to ISO 3923/1-1979.

The dusting of the powder mixtures was measured as the number of counts per minute at a given flow of air by means of an apparatus, type LASER DUST MONITOR "DUSTMATE" LD-1/LD-1(H) supplied by Sibata Scientific Technology Ltd, Tokyo, 110 Japan.

For the determination of bound graphite use was made of an apparatus, type "ROLLER AIR ANALYZER" [see Metals Handbook, 9th edition, Vol. 7, Powder Metallurgy (1984)], in which the powder composition is suspended in an air flow and can be divided into different particle size fractions. After burning organic material at 700° C. for 5 min, the percentage of graphite in the powder is analysed before and after the suspending in the air flow by means of a Carbon Analyzer supplied by Leco, St Joseph, Mich., USA, and the degree of bound graphite is obtained as:

$$\%\text{ bound graphite} = \frac{\%\text{ graphite carbon after suspending} \times 100}{\%\text{ graphite carbon before suspending}}$$

EXAMPLE

Various powder mixtures were produced in the manner which has been generally described above, the composition thereof being as follows:

| Component | % by weight |
|---|---|
| iron powder | 94.7 |
| Ni | 4 |
| graphite | 0.5 |
| binder | 0.8 |

The binders used in the various tests according to the invention were as follows:

| Test No. | Binder | Melting point (°C.) |
|---|---|---|
| 1 | ethylene-bis-12-hydroxystearamide | 145 |
| 2 | ethylene-bis-stearamide | 145 |
| 3 | hexylene-bis-stearamide | 144 |
| 4 | hexylene-bis-behenamide | 142 |
| 5 | distearyladipamide | 140 |

In test No, 6 a reference mixture was also produced in which the binder according to the invention was replaced by an ethylene-bis-stearamide wax, type Hoechst wachs supplied by Hoechst AG. This wax had an average particle size of about 10 μm and had only been premixed with the other components of the powder mixture in a Lödige mixing device, i.e. no mixing during the heating and melting of the wax and the subsequent cooling and solidification of the wax was carried out.

In examining the properties of the powder mixtures, the results shown in Table 1 were obtained.

TABLE 1

| Test No. | Flow (s/50 g) | AD ($g/cm^3$) | Dusting (counts/min) | Bound graphite (%) |
|---|---|---|---|---|
| 1 | 26.9 | 3.23 | 202 | 100 |
| 2 | 30.4 | 3.27 | 554 | 98 |
| 3 | 29.5 | 3.20 | 655 | 86 |
| 4 | 29.4 | 3.22 | 648 | 100 |
| 5 | 28.7 | 3.35 | 209 | 100 |
| 6 | 37.2 | 3.10 | 1850 | 53 |

As can be seen from Table 1, the diamide waxes in combination with the melt-bonding technique result in excellent binding with low dusting values and high values for bound graphite. Especially the powder mixtures 1, 2, 4 and 5 are satisfactory in this respect. Furthermore, the invention provides powder mixtures having good flow as compared to the reference powder mixture of test No. 6.

From the tests and what has besides been said above, it thus is obvious that the technique according to the invention provides powder metallurgical mixtures having good flow and a low degree of segregation and dusting.

We claim:

1. A powder mixture containing a base metal powder, pulverulent additives, a binder and, optionally, a pulverulent lubricant, characterised in that the binder is at least one diamide wax of the general Formula I:

$$\begin{array}{c} Q-R_1 \\ | \\ (CH_2)_n \\ | \\ Q-R_2 \end{array} \qquad (I)$$

wherein $R_1$ and $R_2$ are the same or different and represent a straight, saturated, optionally OH-substituted alkyl group having 13–24 carbon atoms, Q is $$-\overset{\overset{\displaystyle O}{\|}}{C}-NH- \quad \text{or} \quad -NH-\overset{\overset{\displaystyle O}{\|}}{C}-,$$

and n is 1–10, and that the binder is present in molten and subsequently solidified form for binding together the powder particles of the additives with the powder particles of the base metal.

2. The mixture as claimed in claim 1, characterised in that the base metal is iron.

3. The mixture as claimed in claim 1 characterised in that it contains about 0.05–2% by weight of binder, based on the weight of said mixture.

4. The mixture as claimed in claim 3, characterised in that it contains about 0.2–1% by weight of binder.

5. The mixture as claimed in claim 1, characterised in that the binder is ethylene-bis-stearamide of the Formula $$C_{17}H_{35}-\overset{\overset{\displaystyle O}{\|}}{C}-NH-(CH_2)_2-NH-\overset{\overset{\displaystyle O}{\|}}{C}-C_{17}H_{35}$$

* * * * *